US006682057B2

(12) United States Patent
La Crosse

(10) Patent No.: US 6,682,057 B2
(45) Date of Patent: Jan. 27, 2004

(54) AERATOR AND WASTEWATER TREATMENT SYSTEM

(75) Inventor: Gaylen R. La Crosse, Brussels, WI (US)

(73) Assignee: ESTR, Inc., Brussels, WI (US)

( * ) Notice: Subject to any disclaimer, the term of this patent is extended or adjusted under 35 U.S.C. 154(b) by 0 days.

(21) Appl. No.: 09/847,064

(22) Filed: May 1, 2001

(65) Prior Publication Data

US 2002/0163089 A1 Nov. 7, 2002

(51) Int. Cl.[7] ..... B01F 3/04
(52) U.S. Cl. ..... 261/76; 261/79.2; 261/DIG. 75
(58) Field of Search ..... 261/76, 77, 79.2, 261/DIG. 75; 210/221.2, 760, 765

(56) References Cited

U.S. PATENT DOCUMENTS

| | | | | |
|---|---|---|---|---|
| 1,120,129 A | * | 12/1914 | Cable | 261/79.2 |
| 1,205,563 A | * | 11/1916 | Pepper | 261/79.2 |
| 2,106,043 A | * | 1/1938 | Urquhart et al. | 261/76 |
| 2,645,292 A | * | 7/1953 | Williams | 261/76 |
| 3,788,557 A | | 1/1974 | Breunsbach | |
| 3,805,481 A | * | 4/1974 | Armstrong | 261/76 |
| 3,833,719 A | * | 9/1974 | Kuerten et al. | 261/76 |
| 3,884,812 A | | 5/1975 | Lindquist | |
| 4,014,469 A | | 3/1977 | Sato | |
| 4,019,720 A | | 4/1977 | Levesque et al. | |
| 4,370,304 A | | 1/1983 | Hendriks et al. | |
| 4,743,405 A | | 5/1988 | Durão et al. | |
| 4,992,216 A | | 2/1991 | Saita et al. | |
| 5,004,484 A | | 4/1991 | Stirling et al. | |
| 5,298,198 A | | 3/1994 | LaCrosse | |
| 5,403,522 A | | 4/1995 | Von Berg | |
| 5,437,784 A | | 8/1995 | Meinecke et al. | |
| 5,525,242 A | | 6/1996 | Kerecz | |
| 5,951,922 A | * | 9/1999 | Mazzei | 261/76 |
| 2002/0043497 A1 | * | 4/2002 | Wallace | 210/605 |

FOREIGN PATENT DOCUMENTS

| | | | | |
|---|---|---|---|---|
| GB | 147953 | * | 3/1921 | 261/79.2 |

* cited by examiner

*Primary Examiner*—C. Scott Bushey
(74) *Attorney, Agent, or Firm*—Stiennon & Stiennon

(57) ABSTRACT

An aerator has a housing which contains a fluid inlet nozzle and a fluid discharge nozzle positioned on either side of an air inlet formed in a T-pipe. The fluid inlet nozzle has a bore with a flared inlet, and a cylindrical outlet, in which a spiral groove or rifling is formed which extends to the end of the inlet nozzle, allowing the infed contaminated water to pass through, being swirled by the spiral groove, and then exit into an expansion chamber in communication with the air inlet, where air is entrained within the swirling water. Banks of the aerators are used in a wastewater treatment system, having a rectangular tank with a serpentine flow path. Dissolved oxygen meters provide data to a Programmable Logic Controller to control the pumps recirculating liquid within the tank. Pumps are turned on and off to achieve target minimum levels of dissolved oxygen.

14 Claims, 4 Drawing Sheets

AERATOR AND WASTEWATER TREATMENT SYSTEM

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to apparatus for mixing gases and liquids in general and to apparatus for aerating contaminated liquids to promote oxidization and purification in particular.

Standards for the purity of water in rivers, lakes and groundwater are continually increasing in response to legislation, regulation, and community demand. These increasingly stringent standards place a burden on the producers of wastewater, for example, users of pools and spas, agribusiness operators, paper and pulp producers, and others, to discharge wastewater which does not introduce prohibited levels of contaminants or chemicals into the surroundings and groundwater.

Due to the strict regulations, maintenance of water purity by the use of chemical additives such as chlorine in pools and spas has become less desirable.

It is common under many state and federal regulatory regimes that any unauthorized discharge of organic or inorganic waste, or bacteriologically contaminated materials, which exceed regulatory levels must be immediately reported to the authorities.

Although transportation of contaminated wastewater to off-site authorized disposal facilities is permitted, such transportation is in most circumstances prohibitively expensive, especially where large volumes of wastewater are involved. If the contaminated wastewater is categorized as hazardous, prior authorization and permitting may be required.

Wastewater contains biochemical oxygen demand (BOD), ammonia nitrates, phosphorous, bacteria and virus. Prior art systems have introduced chemical agents, particularly chlorine, ozone, or a combination thereof, to oxidize and purify the wastewater. Inorganic contaminants are oxidized to less soluble oxides and organic components are converted to carbonaceous residuals and carbon dioxide. Conventional aerators and injectors utilize pressure and velocity changes of the wastewater flow to introduce air, oxygen or ozone as a vast quantity of minute bubbles ranging in size from about 40 microns to 0.5 microns in diameter. However, prior art injectors typically require high pressures or high flow rates to achieve effective aeration.

In my U.S. Pat. No. 5,298,198, the disclosure of which is incorporated by reference herein, I disclosed an aerator which included an inlet nozzle in a wastewater stream with a flared inlet bore, and a downstream outlet nozzle, positioned after an air inlet, which has a flared bore of greater diameter. This aerator produced excellent results, and was successful at introducing significant quantities of air bubbles of very small size at economical pumping levels. However, even greater performance levels would be desirable. Aerators of greater efficiency would make it possible to retrofit existing installations for greatly increased capacity without significantly increasing the size of the equipment. Moreover, because aerators are usually a part of a continuous treatment process, any improvement in efficiency, that is in converting pump energy into mass of oxygen introduced into the treated water, will be multiplied over many hours of operation and can represent considerable cost savings in terms of reduced power charges, and reduced pump requirements.

SUMMARY OF THE INVENTION

The aerator of this invention has a housing which contains a fluid inlet nozzle and a fluid discharge nozzle positioned on either side of an air inlet formed in a T-pipe. The fluid inlet nozzle has a bore with a flared inlet followed by a cylindrical outlet. The cylindrical outlet has a spiral groove or rifling which extends to the end of the inlet nozzle, allowing the infed contaminated water to pass through and be swirled by the spiral groove, and then exit into an expansion chamber in communication with the air inlet, where air is entrained within the swirling water. The depth of the spiral groove may be from 0.001 inches to 0.125 inches, and may have from 1 to 32 turns per inch. Banks of the aerators are used in a wastewater treatment system, having a rectangular tank with a serpentine flow path. Dissolved oxygen meters provide data to a Programmable Logic Controller to control the pumps recirculating liquid within the tank. Pumps are turned on and off to achieve target minimum levels of dissolved oxygen.

It is an object of the present invention to provide an aerator which efficiently introduces oxygen into water to be treated.

It is another object of the present invention to provide an efficient aerator which can be manufactured economically.

It is a further object of the present invention to provide a water treatment system with increased dissolved oxygen injection based on feedback.

Further objects, features and advantages of the invention will be apparent from the following detailed description when taken in conjunction with the accompanying drawings.

DESCRIPTION OF THE PREFERRED EMBODIMENTS

Figure 1:
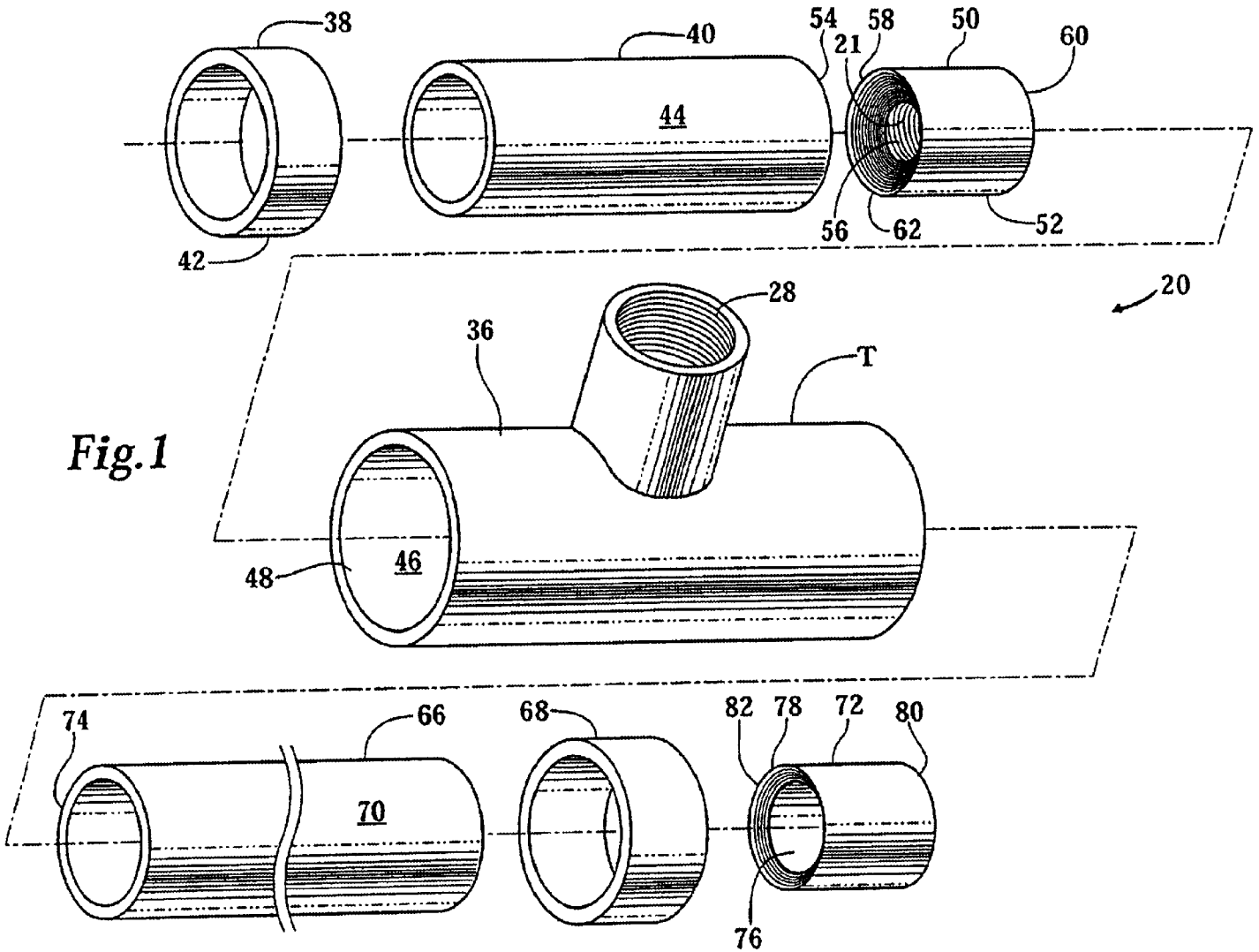
FIG. 1 is an exploded perspective view of the aerator of the present invention.

Referring more particularly to FIGS. 1–9, wherein like numbers refer to similar parts, an aerator 20 is shown in FIG.

1. The aerator 20 may be similar to the aerator disclosed in my prior U.S. Pat. No. 5,298,198 except for the addition of a spiral groove 21 similar to rifling which is formed in the inlet bore 56, and the modification of some pipe lengths as discussed below. The aerator 20 may be used in a variety of fluid treatment applications. The aerator has a corrosion resistant housing 22 preferably formed of conventional PVC pipe fittings, although alternatively molded as a unitary part. The housing 22 has a liquid inlet 24 and a liquid outlet 26. An air inlet 28 is located between the liquid inlet 24 and the liquid outlet 26. The aerator 20 may be installed in a fluid treatment system having various additional pumps, filters, and piping. However, in all cases a supply of fluid 30 which is under pressure will be connected to the liquid inlet 24. The fluid 30 may be wastewater, or other water to which it is desired to add oxygen. The contaminated liquid may constitute water containing human or animal wastes, pool or hot tub discharges, agricultural wastewater or other substance to be treated, industrial plant effluent, or other such fluid substance. Uncontaminated water may be aerated where it is desired to use the oxygenated water for dilution of wastewater.

The aerator 20 may be provided with threaded inlet and outlet fittings for attachment to other threaded conduit, or it may be welded, or adhesively bonded to the piping of a water treatment system. A T-fitting 36 includes the air inlet 28. An inlet bushing 38 extends into the T-fitting 36. In instances where the aerator 20 is to be welded to another plastic pipe, the inlet bushing 38 may be recessed somewhat from the exterior of the T-fitting, to provide a gap to accept additional plastic in the welding process. An inlet tube 40 extends through the inlet bushing 38 into the T-fitting 36. The cylindrical wall 42 of the inlet bushing 38 spaces the exterior surface 44 of the inlet tube 40 from the cylindrical interior surface 46 of the central passage way 48 of the T-fitting 36.

Figure 2:
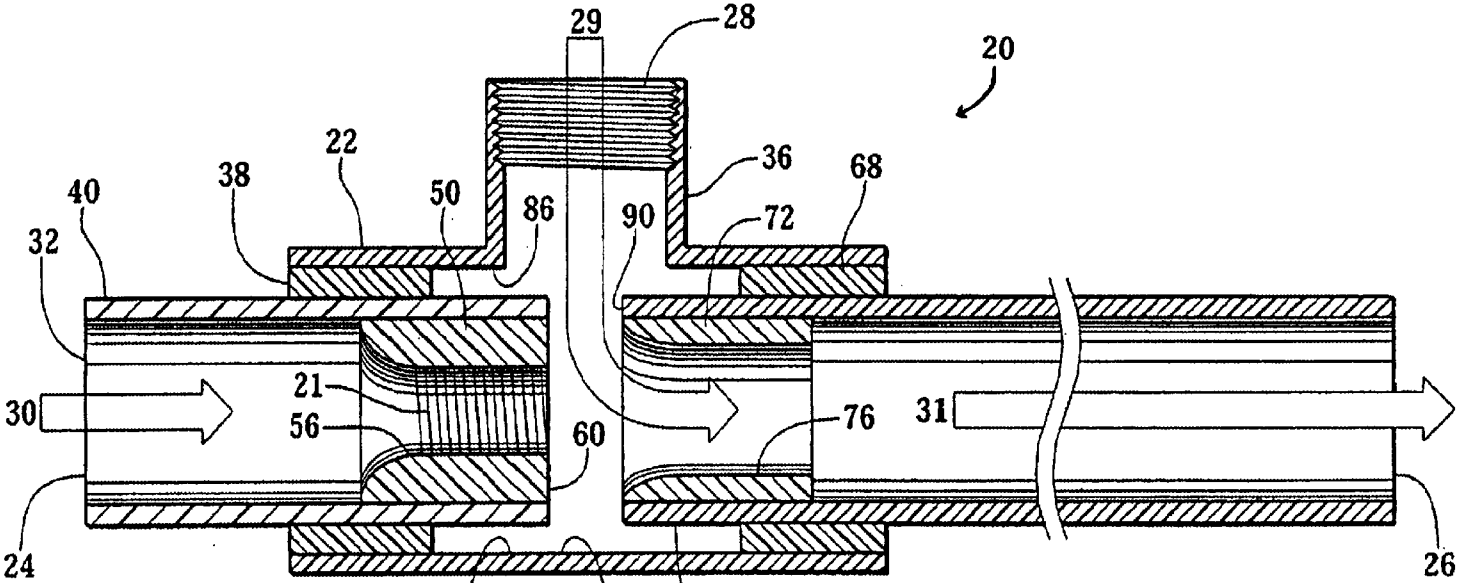
FIG. 2 is a cross-sectional view of the aerator of FIG. 1 with fluid flows indicated schematically.
Figure 6:
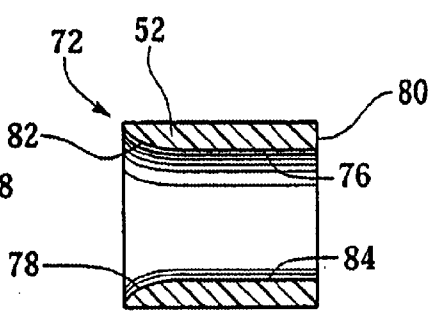
FIG. 6 is a cross-sectional view of the discharge nozzle of FIG. 5 taken along section line 5—5.
Figure 5:
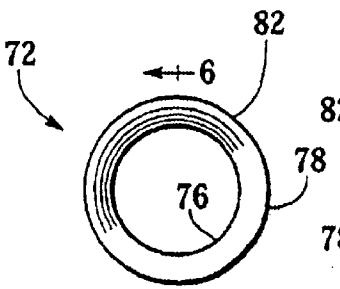
FIG. 5 is a front elevational view of the discharge nozzle of the aerator of FIG. 1.

A plastic inlet nozzle 50 with a cylindrical exterior surface 52 is fixed within the inlet tube 40 adjacent the outlet end 54 of the inlet tube. The inlet nozzle 50, as best shown in FIG. 2, is adhesively attached or welded to the interior of the inlet tube 40 such that liquid entering the aerator 20 passes through the inlet nozzle 50.

Figure 4:
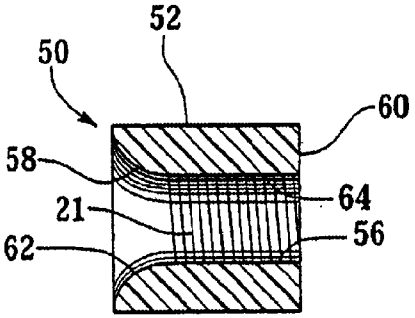
FIG. 4 is a cross-sectional view of the inlet nozzle of FIG. 3 taken along section line 4—4.
Figure 3:
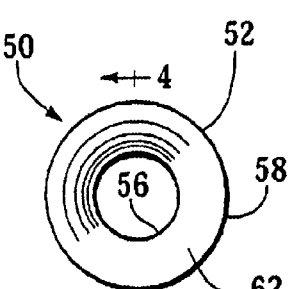
FIG. 3 is a front elevational view of the inlet nozzle of the aerator of FIG. 1.

As best shown in FIGS. 3 and 4, the inlet nozzle 50 is a machined or molded cylindrical block of plastic having an entrance face 58 which opens on the liquid inlet 24 and an exit face 60 which faces the air inlet 28. A bore 56 extends between the entrance face 58 and the exit face 60. The inlet nozzle bore 56 has a flared inlet portion 62 which defines the entrance face 58 and which has a surface which is generally semitoroidal. In a preferred embodiment, the radius of the flared inlet portion 62 is approximately ⅓ the diameter of the inlet nozzle 50. The inlet portion 62 of the bore 56 narrows to a cylindrical exit portion 64 which discharges to the exit face 60 of the inlet nozzle 50. The exit portion 64 intersects the exit face at a right angle. In a preferred embodiment, the cylindrical exit portion 64 of the bore is approximately ½ of the diameter of the inlet nozzle 50. Hence the diameter of the fluid passage within the nozzle at its narrowest is one half the internal diameter of the inlet pipe 40. Preferably, the inlet tube 40 has an internal diameter which is between 190 and 210 percent of the diameter of the inlet nozzle bore exit portion 64.

The effect of the inlet nozzle 50 is to accelerate the flow of fluid, through a process where pressure is converted into velocity by the converging inlet 62 to the nozzle 50. The discharge nozzle 72 receives a jet of fluid from the inlet nozzle 50, and converts the velocity of the jet, which now contains entrained air, back into a pressurized, slower moving, column of water and air 31 which flows through the outlet pipe 26.

As shown in FIG. 4, the spiral groove 21 is formed as a recess within the cylindrical exit portion 64 of the inlet nozzle 50. The groove defines a spiral path extending through the exit portion of the inlet nozzle 50. The groove 21 extends from the beginning of the cylindrical portion of the inlet nozzle 50 and extends to the exit face 60. The depth of the spiral groove 21 may be from 0.001 inches to 0.125 inches, and may have from 1 to 32 turns per inch. The larger depths of spiral would be employed with larger diameter inlet nozzles. The direction of the spiral is counterclockwise when viewed from the inlet end. The illustrated embodiment has 24 grooves per inch along the one-inch long cylindrical portion of the inlet nozzle, and has a depth of about 0.005 inches. The flights of the groove may be inclined from a plane perpendicular to the axis of the inlet nozzle 50, although the inclination may be small.

The bore 56 is preferably machined to have a glass-like finish, and the groove 21 is machined therein. Although the entire inlet nozzle 50 may be molded, rather than machined, the spiral groove 21 should still be machined for the quality of the groove cut.

As shown in FIG. 1, a discharge tube 66 extends from within the T-fitting 36 through a discharge bushing 68. While the inlet tube may be about 2¾ inches long, the discharge tube 66 will be longer, and may be about 12 inches long in the illustrated embodiment. The discharge bushing 68 spaces the exterior surface 70 of the discharge tube 66 from the interior surface 46 of the T-fitting central passageway 48. A machined or molded discharge nozzle 72 is connected within the discharge tube adjacent the inlet end 74 of the discharge tube 66.

The discharge nozzle is a cylindrical block of plastic having a bore 76 which extends therethrough. The bore extends from an entrance face 78 which opens towards the inlet nozzle 50 to an exit face 80 which faces the liquid outlet 26. The discharge nozzle bore 76 has a flared inlet portion 82 with a surface which corresponds to the entrance face 78 and which is substantially semitoroidal. The radius of the flared inlet portion of the bore in a preferred embodiment is also approximately ⅓ the diameter of the discharge nozzle. The discharge nozzle bore has a cylindrical exit portion 84 which is continuous with the flared entrance portion 78. The diameter of the discharge nozzle exit portion 84 is greater than the diameter of the inlet nozzle 50 exit portion 64. In a preferred embodiment, the discharge nozzle bore exit portion 84 is approximately ¾ the diameter of the discharge nozzle. It should be noted that although the radius of the semitoroidal surfaces of the inlet nozzle 50 and discharge nozzle 72 are in a preferred embodiment equivalent, the geometry of the two exit faces 60, 80 is not congruent, as they represent segments of tori having different diameters.

As best shown in FIG. 2, an expansion chamber 86 is formed beneath the air inlet 28 of the T-fitting 36 and between the portions of the inlet tube 40 and the discharge tube 66 which extend from the inlet bushing 38 and discharge bushing 68 within the central passageway 48 of the T-fitting 36.

The expansion chamber 86 has an annular region or volume 88 defined between the interior surface 46 of the T-fitting central passageway 48 and the exterior surfaces of the inlet tube 40 and discharge tube 66. The expansion chamber annular region 88 has an exterior diameter which is between 160 percent and 180 percent of the diameter of the inlet nozzle bore exit portion. The expansion chamber further comprises a gap 90 between the exit face 60 of the inlet nozzle 50 and the entrance face 78 of the discharge nozzle 72. The air inlet discharges directly into the gap 90.

The width of the gap 90 is preferably between 90 percent and 140 percent of the diameter of the inlet nozzle bore exit portion 64.

As liquid flows through the central passageway 48 of the T-fitting 36, air is drawn through the inlet from atmosphere or a connected air conduit or air supply (not shown).

The aerator 20 operates to cause intensive and effective mixing of the air 29 with the contaminated liquid 30 within the expansion chamber 86. Contaminated liquid 30 is introduced to the aerator 20 through the liquid inlet 24. The liquid, coming from a wastewater source, is pumped under pressure through the aerator 20. The liquid 30 flows into the inlet tube 40. As the opening diameter through which the fluid must pass is constricted greatly by the inlet nozzle 50, the velocity of the contaminated fluid increases and swirls as it passes through the inlet nozzle 50. At the exit face 60 of the nozzle 50 the fluid is instantaneously discharged into the expansion chamber 86 which is open to atmospheric pressure directly or indirectly through the air inlet 28. The turbulence and pressure drop facilitates the formation of very small diameter air bubbles within the fluid which is then forced into the discharge nozzle 72 which narrows in diameter with a resultant increase in the velocity of the air-fluid mixture 31. The aerator 20 has been found to be particularly effective at entraining air even at relatively low inlet fluid pressures. While common prior art aerators have entrained in the vicinity of one kilogram of oxygen in the treated fluid for each kilowatt-hour (kWh) of pumping power, the aerator 20 has been effective to introduce levels of oxygen in excess of 2 kilograms per kWh. For example, an aerator 20, having inlet and discharge nozzles 50, 72, of an exterior diameter of 1.047 inches with an inlet bore exit portion 64 diameter of 0.50 inches and a discharge nozzle bore exit portion 84 diameter of 0.75 inches located within a T-fitting having a central passage diameter of approximately 1.75 inches with a space between the inlet tube and the exit tube of 0.50 inches yielded 4.25 Kg of $O_2$ per kWh of 0.5 to 5.0 micron bubbles, as compared to 0.8 to 1.0 Kg of $O_2$ per kWh from rotor aerators, or 1.25 Kg of $O_2$ per kWh for a similar aerator without rifling, such as is disclosed in my earlier U.S. Pat. No. 5,298,198.

Because of the complexities of fluid mechanics, especially those involving turbulent or partially turbulent flows, it is not possible to give a precise analytic explanation of the dramatic improvement in performance observed in the aerator 20. However, it is believed that the improvement comes about by making a greater proportion of the stream of fluid exiting the inlet nozzle available for contact with the air within the expansion chamber 86. Because of the venturi effect, a negative pressure is produced within the expansion chamber. The water flowing through the inlet nozzle 50 will be swirling as it enters the expansion chamber, and the stream may thus produce a greater surface area for air-liquid mixing. However, additional more complex mechanisms may be involved.

By effectively aerating water at low pressures, the aerator 20 may be fabricated of lower cost materials such as PVC pipe which need not be able to withstand extremely high pressures. Furthermore, such an aerator may be effectively utilized without the need for high pressure pumps. For example, the aerator 20 may be employed within the recirculation stream of a domestic swimming pool or hot tub. Effective aeration removes or reduces the BOD, ammonia nitrates, phosphorous, bacteria and virus. As high pressures are not required to operate the aerator 20, it may be operated by low capacity pumps.

The aerator 20 may also, for example, be used in conjunction with agricultural waste treatment. The contents of a swine manure holding pond, for example, may be processed through the aerator 20 or a bank of such aerators, to reduce the contaminant contents to acceptable levels and reduce objectionable odors. The aerator may also be used in banks or arrays of aerators to handle larger quantities of wastewater, such as may be observed in the effluent from various industrial processes. Examples of such wastewater treatment systems are shown in FIGS. 7–9.

Figure 8:
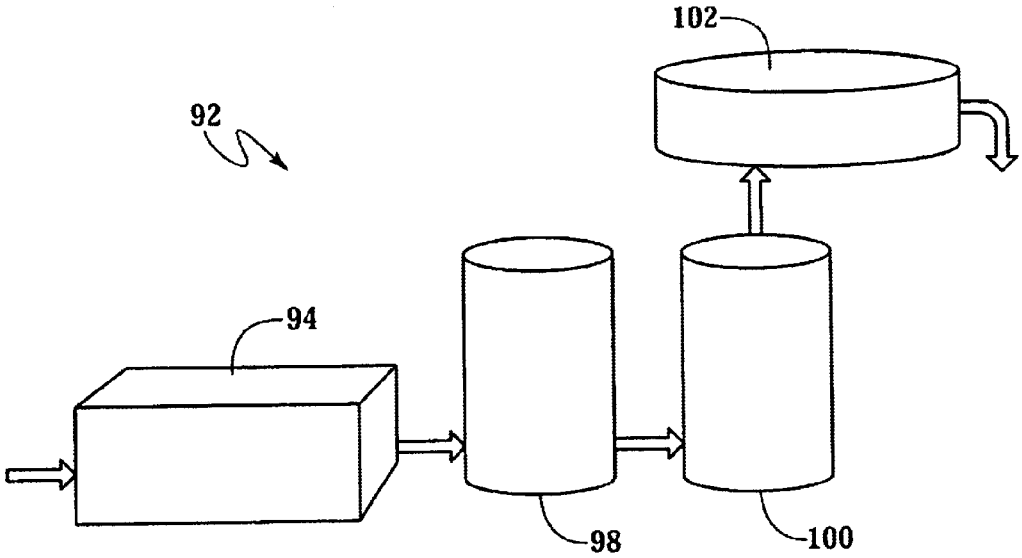
FIG. 8 is a schematic view of a wastewater treatment system employing the treatment basin of FIG. 7.
Figure 9:
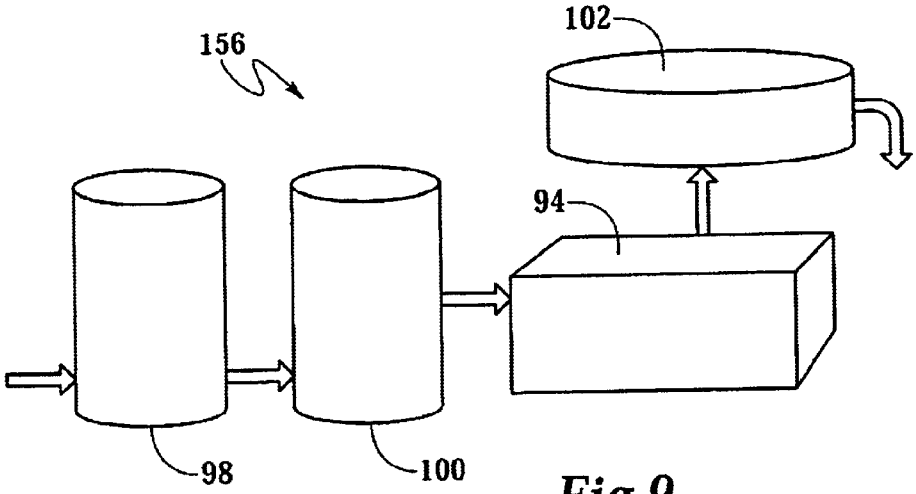
FIG. 9 is a schematic view of an alternative embodiment wastewater treatment system employing the treatment basin of FIG. 7.

The wastewater treatment system 92, shown in FIG. 8, has an aeration basin 94 which receives effluent 96 from a factory or mill. The effluent 96 or wastewater is aerated within the basin 94, and caused to reside within the basin for a period of time which is appropriate for the composition of the effluent 96. It is then passed to a first holding tank 98 and a second holding tank 100 for additional residency time, and then finally to a clarifier 102, which may be of conventional design, for removal of solids and final disposition of the treated liquid.

Figure 7:
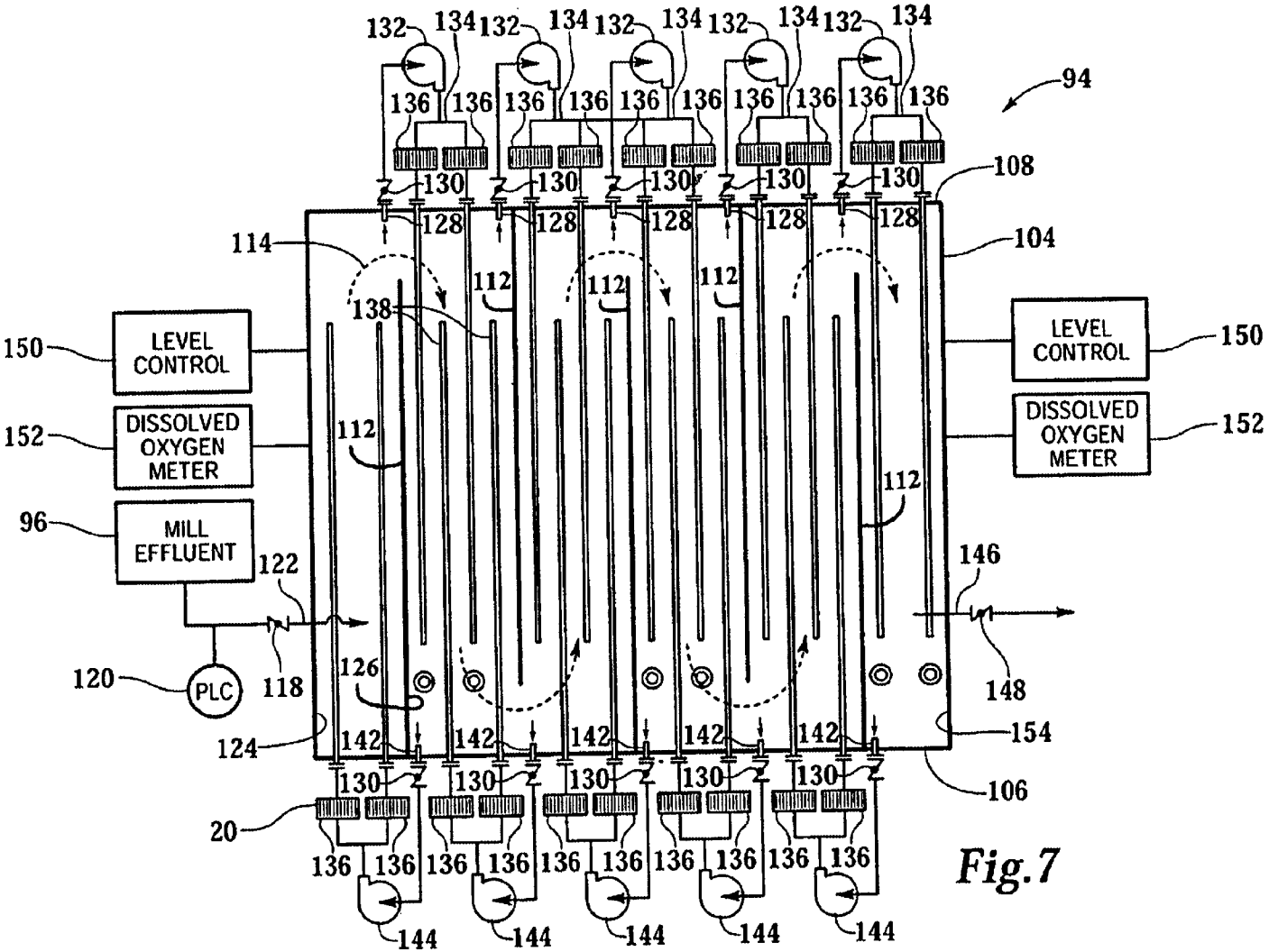
FIG. 7 is a schematic view of a treatment basin of a wastewater treatment system of this invention employing banks of the aerators of FIG. 1.

The aeration basin 94, as shown in FIG. 7, has a rectangular tank 104 about 11.5 feet deep. The tank 104 has side walls 106 which define an interior compartment 108 having a volume of as much as 160,000 gallons, although generally the tank will be run at a five foot depth, with a volume of about 80,000 gallons. The tank 104 may be open upwardly, or may have a top with a plurality of vents such that the interior compartment 108 is in communication wit atmospheric pressure. The tank interior compartment 108 is divided into six sections by divider walls 112 which extend inwardly from opposite side walls 106 to define a serpentine flow path 114 which extends through all the sections.

The aeration basin 94 receives the liquid effluent from a mill or other wastewater source. A butterfly valve 118 under the control of a programmable logic controller (PLC) 120 is positioned in the inlet conduit 122 to control admission of the effluent into the interior compartment 108. When the valve 118 is open, the wastewater is discharged into the interior compartment 108 of the tank 104. The water flows through the first section 124 of the serpentine path 114, and travels to the second section 126. At about the midpoint between the first section 124 and the second section, a first aerator intake 128 extends through a side wall 106, through a butterfly valve 130 and through a pump 132 which pumps the liquid into a manifold 134 which directs the liquid into two aerator banks 136. Each aerator bank has ten identical injectors or aerators 20, which are each in communication with the atmospheres and which operate as discussed above to introduce oxygen into the flow of water. Each aerator 20 has a spiral groove as discussed in detail above. The aerator banks 136 are preferably located at a level about 9 feet above the bottom of the tank 104. This elevated placement of the aerators avoids the escape of water through the air inlets of the aerators 20 should a pump be shut down or fail. If it is desired to place the aerator banks 136 at an elevation below the level of the water within the tank, the air inlets of the aerators 20 should be connected to conduits which extend to a level above water level. Commonly, the system will operate with the tanks filled to a depth of about 5 feet, although the level may be varied depending on the residency time within the tank required for the wastewater.

Each bank of aerators 136 is connected to a common outlet manifold which is joined to a single discharge pipe 138 which extends through the tank side wall 106 and into the second section 126 of the interior compartment 108. The centers of the discharge pipes 138 are positioned about 9 inches from the bottom wall of the tank 104. The discharge pipes 138 extend within the tank section 126 approximately parallel to the divider walls 112. Each discharge pipe 138 has evenly spaced spray holes, not shown, along its length.

The discharge pipes are 4" IPS, with discharge holes located on the top and bottom to prevent solids settling. The holes are on 2'-0" centers, starting 3" from the end and continuing the entire length of the pipe, which is about 40'-0" long. The holes are ⅝" diameter. The length of piping will vary from installation to installation. In some installations the holes may be positioned on the sides of the discharge pipes instead of on top and bottom.

The water leaving the aerator banks 136 is thus introduced into the flow of water moving along the serpentine path 114. A second aerator intake 142 is positioned downstream of the discharge pipes 138. The second aerator intake 142 conducts fluid through a butterfly valve to a second pump 144, which pumps the fluid through a second group of aerator banks, and then through discharge pipes 138 into the first section 124 of the serpentine path 114.

Additional aerator inlets and discharge pipes are positioned along the length of the serpentine flow path 114 as shown in FIG. 7, together with additional pumps and valves which have the effect of recirculating the fluid many times within the tank 104 and continuously adding additional oxygen to the wastewater retained within the tank. Typically, about 30 gallons per minute of liquid will pass through each of the 200 injectors in the aeration basin 94, for a top recirculation level of about 8.6 million gallons per day. After passing though all the sections of the serpentine path 114, the fluid passes out of the tank 104 at a fluid outlet 146, also controlled by a butterfly valve 148. Typically, the flow into and out of the tank 104 will be about 0.41 million gallons a day. The amount of flow through the tank can be controlled by the inlet valve 118 and the outlet valve 148. If it is desired to increase the residence time within the tank, the level of the fluid within the interior compartment can be increased, and the outlet valve 148 can be controlled to achieve the desired flow rates and residence time.

A level control sensor 150 and a dissolved oxygen meter 152 are positioned in communication with the interior compartment 108 of the tank 104 within the first section 124. Another level control sensor 150 and dissolved oxygen meter 152 are positioned within the last section 154 of the tank. The data detected by the level control sensors 150 and the dissolved oxygen meters 152 are communicated to the PLC 120 which controls the pumps 132, 144, as well as the valves 118, 130,148 to obtain the desired levels of performance in the aeration basin 94.

System operation is based on obtaining a desired level of dissolved oxygen within the tank 104, for example, a minimum level of 2.5 parts per million (ppm). The levels of dissolved oxygen detected by the two meters 152 are averaged to give a current average level throughout the tank. If the dissolved oxygen level is too low, the PLC 120 may activate additional pumps to add additional aeration to the water residing within the tank, or residence time can be increased by shutting the outlet valve. If the dissolved oxygen level is higher than is desirable, then one or more pumps may be shut down. To limit settling of solids, the PLC operates to turn off pumps sequentially along the serpentine flow path. Additional pumps, not shown, may be piped in as spares, for example a spare pump on each side of the tank. The spare pumps may be used in case of malfunction of one of the regular pumps, or may be brought in under high load conditions when extra capacity is called for. The PLC operates with the water level sensors 150 to adjust the level of fluid within the tank as desired.

The fluid which leaves the aeration basin 94 then enters the first holding tank 98, the second holding tank 100, and the clarifier 102. In an alternative embodiment system 156 shown in FIG. 9, the wastewater enters the holding tanks 98, 100, before entering the aeration basin 94, and then goes on to the clarifier 102. The systems 92, 156 are examples of the aeration basin 94 being added to the waste water treatment facility of an existing plant. By introducing the aeration basin 94 into an existing system, it is possible to operate the plant continuously, without the need to shut down operation of the plant for any extended period of time. Because operation of an aeration facility such as this requires a period of days for the proper bacteria culture to develop within the retained wastewater to address the particular components of that wastewater, it is not possible to instantly satisfy a plant's treatment needs with a newly constructed aeration basin. In the illustrated systems, it is possible to introduce the system in line with existing treatment systems. After a period of time, it will be possible to reroute the fluid flows to cut out the holding tanks 98, 100 entirely, and to conduct the wastewater directly to the aeration basin 94, and from the aeration basin 94 to the clarifier 102. Or, in new construction, no additional holding tanks 98, 100 will be necessary.

It should be understood that the aerator 20 is believed to achieve better functionality through the use of a groove like structure to cause at least the outer portion of the inlet jet to rotate, and that other structures, such as that of a polygonal bore which is twisted about a central axis, as is sometimes used in gun barrels, could be used.

It should be noted that where the term air has been used in this application, atmospheric air, compressed air, enriched air, oxygen, ozone, or combinations thereof are included.

It is understood that the invention is not limited to the particular construction and arrangement of parts herein illustrated and described, but embraces all such modified forms thereof as come within the scope of the following claims.

I claim:

1. An aerator for treatment of a liquid, comprising:

a housing having an interior with an inlet for the entrance of the liquid, and an outlet for the exit of the liquid;

an air inlet located in the housing between the liquid inlet and the liquid outlet;

an inlet nozzle located in the housing between the liquid inlet and the air inlet, the inlet nozzle having an entrance face and a bore which extends through the nozzle to an exit face, wherein the bore has a substantially cylindrical exit portion of a first diameter which discharges at the exit face, and wherein the bore has an inlet portion of a second greater diameter than the first diameter and said bore is flared towards the housing liquid inlet, the bore inlet portion being joined to the bore exit portion and providing a smooth transition from said second diameter to said first diameter;

portions of the inlet nozzle bore exit portion which define a spiral groove which extends from the inlet nozzle bore inlet portion to the exit face;

a discharge nozzle located in the housing between the air inlet and the liquid outlet, the discharge nozzle having an entrance face and a bore which extends through the discharge nozzle to a discharge nozzle exit face; and an expansion chamber defined within the housing between the inlet nozzle and the discharge nozzle and in communication with the air inlet, the expansion chamber having a gap between the inlet nozzle and the discharge nozzle.

2. The aerator of claim 1 wherein the expansion chamber has a generally cylindrical gap between the inlet nozzle and the outlet nozzle, the width of the gap being between 90 and 140 percent of the diameter of the inlet nozzle bore exit portion.

3. The aerator of claim 1 wherein the spiral groove has a depth of between 0.001 inches to 0.125 inches.

4. The aerator of claim 1 wherein the spiral groove makes between 1 to 32 twists per inch.

5. An aerator for treatment of liquid, comprising:

a housing having an interior with an inlet for the entrance of the liquid, and an outlet for the exit of the liquid;

an air inlet located in the housing between the liquid inlet and the liquid outlet;

an inlet nozzle located in the housing between the liquid inlet and the air inlet, the inlet nozzle having an entrance face and a bore which extends through the nozzle to an exit face, wherein the bore has a substantially cylindrical exit portion of a first diameter which discharges at the exit face, and wherein the bore has an inlet portion of a second greater diameter than the first diameter and said bore inlet portion converges as it extends downstream, the bore inlet portion being joined to the bore exit portion and providing a smooth transition from said second diameter to said first diameter;

portions of the inlet nozzle bore exit portion defining a spiral groove which extends from the inlet nozzle bore inlet portion to the exit face;

a discharge nozzle located in the housing between the air inlet and the liquid outlet, the discharge nozzle having an entrance face and a bore which extends through the discharge nozzle to a discharge nozzle exit face, wherein the discharge bore has a substantially cylindrical exit portion of a third diameter which discharges at the discharge nozzle exit face, and wherein the discharge nozzle bore has an inlet portion of a fourth diameter which is greater than the third diameter and which is flared towards the inlet nozzle, and wherein the third diameter is greater than the first diameter; and an expansion chamber defined within the housing beneath the air inlet and between the inlet nozzle and the discharge nozzle, the expansion chamber having a gap between the inlet nozzle and the discharge nozzle which communicates with an annular region defined between the nozzles and the interior of the housing.

6. The aerator of claim 5 wherein the expansion chamber has a generally cylindrical gap between the inlet nozzle and the outlet nozzle, the width of the gap being between 90 and 140 percent of the diameter of the inlet nozzle bore exit portion.

7. The aerator of claim 5 wherein the spiral groove has a depth of between 0.001 inches to 0.125 inches.

8. The aerator of claim 5 wherein the spiral groove makes between 1 to 32 twists per inch.

9. An apparatus for treatment of contaminated water, comprising:

a housing having an inlet for entrance of contaminated water, an outlet for the exit of treated water, and an inlet for air located between the liquid inlet and the liquid outlet;

an inlet nozzle located within the housing between the liquid inlet and the air inlet, the inlet nozzle having a bore which extends therethrough and which has an inlet portion which is flared and of greater diameter than a cylindrical exit portion, and wherein portions of the inlet nozzle cylindrical exit portion define a spiral path extending along the bore cylindrical exit portion;

a discharge nozzle located within the housing between the liquid outlet and the air inlet; and an expansion chamber located within the housing and defined between the inlet nozzle and the discharge nozzle, the apparatus being effective to introduce a quantity of oxygen into the contaminated water in excess of two kilograms per kilowatt hour of power expended in pumping the contaminated water through the aerator.

10. The apparatus of claim 9 wherein the expansion chamber has a generally cylindrical gap between the inlet nozzle and the outlet nozzle, the width of the gap being between 90 and 140 percent of the diameter of the inlet nozzle bore exit portion.

11. The aerator of claim 9 wherein the spiral groove has a depth of between 0.001 inches to 0.125 inches.

12. The aerator of claim 9 wherein the spiral groove makes between 1 to 32 twists per inch.

13. A system for the treatment of wastewater, comprising:

a tank;

at least one pump;

a plurality of aerators connected to a discharge pipe which empties into the tank, and connected to receive water from within the tank as supplied by the pump, wherein each aerator comprises:

a housing having an interior with an inlet for the entrance of liquid, and an outlet for the exit of liquid;

an air inlet located in the housing between the liquid inlet and the liquid outlet;

an inlet nozzle located in the housing between the liquid inlet and the air inlet, the inlet nozzle having an entrance face and a bore which extends through the nozzle to an exit face, wherein the bore has a substantially cylindrical exit portion of a first diameter which discharges at the exit face, and wherein the bore has an inlet portion of a second greater diameter than the first diameter and said bore is flared towards the housing liquid inlet, the bore inlet portion being joined to the bore exit portion and providing a smooth transition from said second diameter to said first diameter;

portions of the inlet nozzle bore exit portion which define a spiral groove which extends from the inlet nozzle bore inlet portion to the exit face;

a discharge nozzle located in the housing between the air inlet and the liquid outlet, the discharge nozzle having an entrance face and a bore which extends through the discharge nozzle to a discharge nozzle exit face; and an expansion chamber defined within the housing between the inlet nozzle and the discharge nozzle and in communication with the air inlet, the expansion chamber having a gap between the inlet nozzle and the discharge nozzle.

14. The system of claim 13 further comprising:

at least one dissolved oxygen meter positioned within the tank in contact with the wastewater; and a controller which receives information about the dissolved oxygen level within the tank from the dissolved oxygen meter, wherein the controller is connected to the pump to control the pump to increase or decrease the amount of aeration of the water within the tank to obtain a desired level of dissolved oxygen within the tank.

* * * * *